United States Patent [19]

Smith et al.

[11] 4,312,507

[45] Jan. 26, 1982

[54] PORTABLE LIGHTED STUDY OR GAME TRAY

[76] Inventors: Billy E. Smith; Carol H. Smith, both of 821 N. Tenth St., Opelika, Ala. 36801

[21] Appl. No.: 193,450

[22] Filed: Oct. 3, 1980

[51] Int. Cl.[3] ..... A63F 3/02

[52] U.S. Cl. ..... 273/237; 108/23; 108/25; 273/287; 273/309; 434/429; 434/432

[58] Field of Search ..... 273/237, 287, 309; 108/23, 25, 43; 434/432, 429

[56] References Cited

U.S. PATENT DOCUMENTS

| | | | |
|---|---|---|---|
| 776,355 | 11/1904 | Selander | 108/25 |
| 1,286,385 | 12/1918 | Minoff | 273/287 |
| 1,436,859 | 11/1922 | Bush | 108/25 X |
| 1,940,094 | 12/1933 | Lobel et al. | 273/287 X |
| 2,031,304 | 2/1936 | Eller | 108/23 |
| 3,123,935 | 3/1964 | Williams | 108/43 X |
| 3,917,275 | 11/1975 | Alpher | 273/237 |

*Primary Examiner*—Anton O. Oechsle

*Attorney, Agent, or Firm*—Frederick L. Bergert

[57] ABSTRACT

A portable tray for use in various activities such as study or games is disclosed. The tray includes an accessory bag located beneath the center portion of the tray, with a hinged cover which folds flat with the main portion of the base. Hinged legs are provided on the under side of the tray to provide support during use. The sides of the base are curved outwardly toward the user to increase the adjacent usable tray surface. A detachable light is conveniently mounted on the rear of the tray.

4 Claims, 4 Drawing Figures

FIG. 1
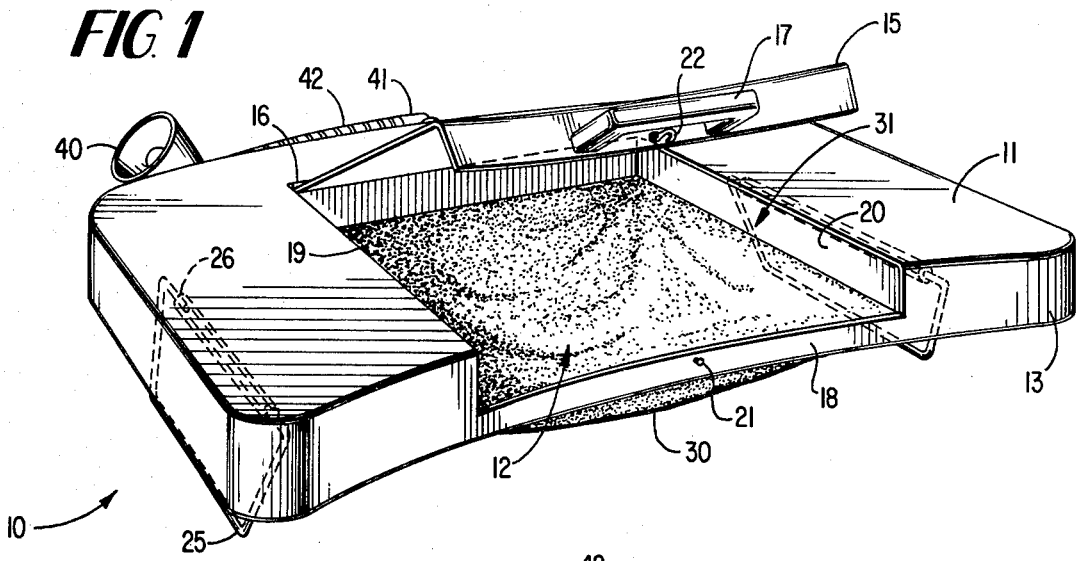
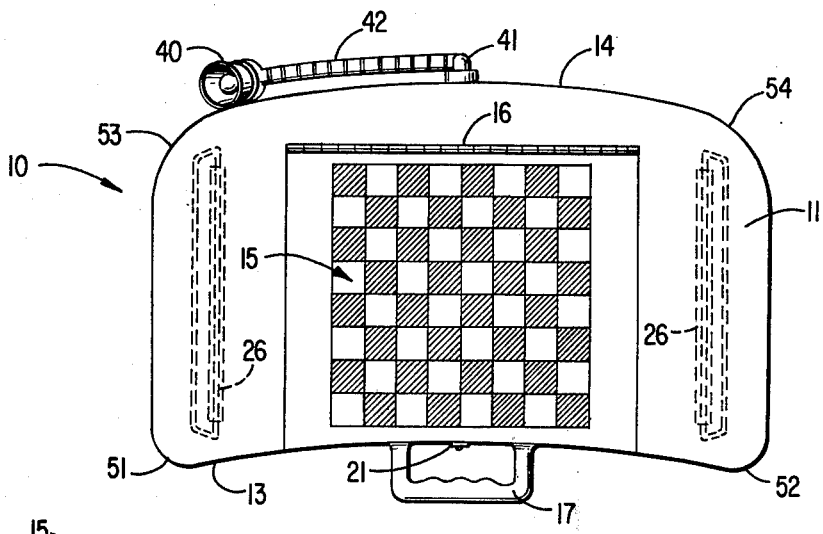
FIG. 2
FIG. 3
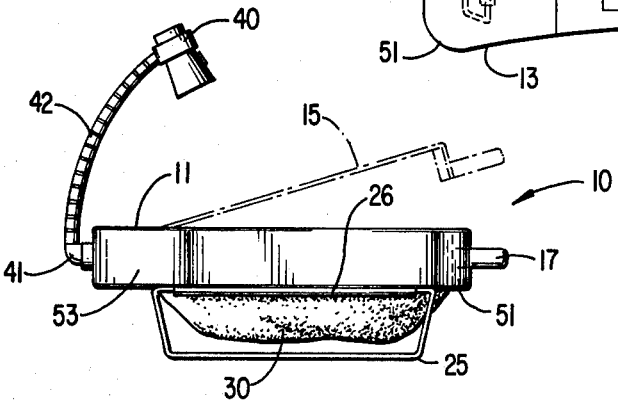
FIG. 4
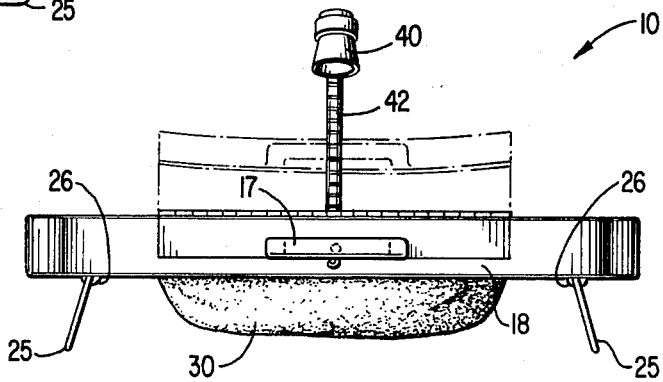

PORTABLE LIGHTED STUDY OR GAME TRAY

BACKGROUND AND SUMMARY OF THE INVENTION

The present invention relates to a portable tray which may be employed in various activities such as study or for games or other suitable purpose. More particularly, the present invention relates to a portable tray having features, including a conveniently located accessory bag, a hinged lid with game indicia on the upper surface thereof, supporting hinged legs and a detachable light, all of which assist in making the tray suitable for use in any of various circumstances.

Previous configurations of portable game boards or kits are described, for example, in U.S. Pat. Nos. 3,930,652 and 3,917,275, while various table configurations of the prior art are described in U.S. Pat. Nos. 1,568,154, 1,781,423 and 1,803,830.

By the present invention, there is provided a portable lighted study or game tray having advantages and features which make the tray adaptable for multiple uses in any of various circumstances or environments. The portable tray of the present invention includes a main planar base member, having an accessory bag located immediately below the center front portion thereof, and with a cover top having game indicia on the upper surface thereof being coplanar with the base of the tray so as to form one continuous flat surface when the cover is in the closed position. A pair of support legs are located on the lower extremities of the tray and a detachable light is provided at the rear of the tray. The portable tray of the present invention is of lightweight construction, as well as quite compact and well suited for the use to which it may be employed with various games or for study purposes or the like.

BRIEF DESCRIPTION OF THE DRAWINGS

The advantages and features of the portable tray of the present invention will be more fully understood from the following description of the preferred embodiments, taken in conjunction with the accompanying drawings wherein:

FIG. 1 is a perspective view of the portable tray of the present invention;

FIG. 2 is a plan view of the portable tray shown in FIG. 1;

FIG. 3 is a side elevational view of the portable tray shown in FIG. 1; and FIG. 4 is a front elevational view of the portable tray shown in FIG. 1.

DESCRIPTION OF THE PREFERRED EMBODIMENTS

In the embodiment of the portable tray of the present invention as shown in FIGS. 1 through 4, there is provided a portable tray 10, including a base 11 having a planar surface in the general shape of a rectangle, as viewed from above. An opening 12 is located in the mid-portion of the base member 11, with the opening being generally square-shaped and extending from one 13 of the longer sides 13, 14 of the base 11 across to the center portion of the base 11. These longer sides 13, 14 represent the front and back sides, respectively, of the tray 10 when in use.

As shown in FIG. 2, for example, the corners 51, 52 of the front side 13 of the tray 10 are rounded or curved outwardly so as to extend toward the person using the tray 10, thus providing additional usable surface immediately adjacent to the user of the tray 10. The corners 53, 54 of the back side 14 of the tray 10 are preferably rounded to provide a streamlined surface which prevents hitting of the tray 10 against adjacent objects when in use.

A top cover member 15 is hingedly attached along the inner edge 16 of the opening 12 and covers the opening 12 when in a horizontal position, being coplanar with the base 11 so as to form one continuous flat surface when the cover 15 is in the closed position. The cover 15 is provided on its upper surface with game indicia such as a checkerboard, as shown in FIG. 2.

A handle member 17 is attached to the outer edge 18 of the cover member 15 to facilitate raising and lowering of the cover 15. A longitudinal frame member 18 is attached between the sides 19, 20 of the opening 12 at the extreme outer ends thereof, being coextensive with side 13, to provide a support for the outer edge of the cover 15 in the closed position. A peg 21 is located in the outer surface of the frame member 18 for engagement by a latch hook 22 in the outer edge of the cover 15 in order to secure the cover in the closed position when desired. The base 11 and cover 15 may be constructed of plastic, metal or other lightweight, durable material.

A pair of folding legs 25, of wire or other suitable material, are attached to the under sides of the base 11 extending from front to back of the tray 10 in parallel relation. The legs 25 are attached to the base 11 by hinges 26 which allow the legs 25 to be swung from a vertical operative position to a horizontal position against the under sides of the base 11, so as to be out of the way when not in use. The legs 25 provide support for the tray 10, for example, on a table, car seat or the lap of the person using the tray 10. Preferably, the legs 25 will have a flat center portion, so as to rest easily on the supporting surface, with the end portions extending upwardly to points of attachment to the base 11, as shown in FIG. 3. This flat center portion should extend for at lest two-thirds of the width of the tray 10, in order to provide proper support and to prevent unsteadiness or any rocking action of the tray 10 when in use.

Beneath the cover member 15 there is provided an accessory bag 30 having sides which are generally square shaped and coextensive with the sides 16, 18, 19, 20 of the opening 12 in the base 11, and being secured to these sides 16, 18, 19, 20 by suitable means such as adhesive sealing material. The accessory bag 30 may be made of any suitable resilient, durable material and is formed with a pocket 31 therein so as to extend below the base 11 approximately the same distance as the folding legs 25. The pocket 31 is for the purpose of holding various game implements, such as checkers, dominoes, cards or the like, or for items employed in study or school work, such as pencils, notebooks, or other items.

A detachable battery operated light 40 is mounted at the rear of the base member 11 by any suitable means such as a pair of brackets 41. The light 40 is preferably provided with a flexible arm 42 to allow the light 40 to be moved to various positions above the surface of the base member 11 to provide better viewing of the game or book or the like which is resting on the top surface of the base member 11. The light 40 is mounted at the mid-point of the back side 14 of the tray 10 in order to allow light to be distributed over the surface of the tray 10 as evenly as possible, while also locating the light 40 in an out of the way position.

The accessory bag 30 may be employed to hold various game or study implements, as previously described, with such implements being readily available beneath the accessory bag cover lid 15, and yet being suitably stored when not in use. The portable lighted study and play tray 10 of the present invention provides a compact, readily transported device which may be quickly and easily used, and with readily available game or study implements which may be stored in the accessory bag 30 which is provided as an integral component of the invention.

It is thought that the invention and many of its attendant advantages will be understood from the foregoing description, and it will be apparent that various changes may be made in the form, construction and arrangement of the parts without departing from the spirit and scope of the invention or sacrificing its material advantages, the forms hereinbefore described being merely preferred embodiments thereof.

It is claimed:

1. A portable lighted study or game tray, comprising: a planar base member of generally rectangular shape for use by a person positioned adjacent one of the long sides of the rectangle; the two corners of said base member adjacent said long side of the rectangle adjacent the user being rounded and extending beyond said rectangle in the direction of the user; an opening in the base member, said opening being generally square-shaped and extending from the side of the base member adjacent the user to a position in the center portion of said base member; a downwardly extending accessory bag attached around the interior sides of the base member adjacent said opening; a cover lid hingedly attached to the base member along the side of the opening opposite said user, said cover lid having game indicia on the upper surface thereof and being generally flat and coplanar with the base member in the horizontal or closed position of said cover lid; a pair of folding legs attached to the underside of said base member and extending generally parallel to the short sides of said rectangular base member, said legs including means for folding said legs flat against the underside of said base member; a flexible arm attached to the base member adjacent the side opposite the user, said flexible arm having means for detachably receiving a light source at the end portion thereof; and a light source positioned in said end portion of the flexible arm.

2. The portable tray of claim 1, wherein the legs are formed of rod-shaped members having a flat center portion which extends for at least two-thirds the width of the tray, with the end portions thereof extending upwardly to points of attachment to the base, thus providing stability during use of the legs to support the tray.

3. The portable tray of claim 1, wherein the accessory bag extends below the base approximately the same distance as the folding legs.

4. The portable tray of claim 1, wherein the flexible arm for the light source is mounted on the base at the midpoint of the side opposite the user.

* * * * *